US008886101B2

(12) United States Patent
Kawata et al.

(10) Patent No.: US 8,886,101 B2
(45) Date of Patent: Nov. 11, 2014

(54) FIXING DEVICE CAPABLE OF ENHANCING DURABILITY OF ENDLESS BELT AND IMAGE FORMING APPARATUS INCORPORATING THE SAME

(71) Applicants: Teppei Kawata, Kanagawa (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Kensuke Yamaji, Kanagawa (JP); Takamasa Hase, Shizuoka (JP); Toshihiko Shimokawa, Kanagawa (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(72) Inventors: Teppei Kawata, Kanagawa (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Kensuke Yamaji, Kanagawa (JP); Takamasa Hase, Shizuoka (JP); Toshihiko Shimokawa, Kanagawa (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 13/677,597

(22) Filed: Nov. 15, 2012

(65) Prior Publication Data

US 2013/0177340 A1 Jul. 11, 2013

(30) Foreign Application Priority Data

Jan. 11, 2012 (JP) ..... 2012-003264

(51) Int. Cl.
*G03G 15/20* (2006.01)

(52) U.S. Cl.
CPC .... *G03G 15/2064* (2013.01); *G03G 2215/2035* (2013.01); *G03G 15/2053* (2013.01)
USPC ..... 399/329

(58) Field of Classification Search
CPC ..... G03G 2215/2035; G03G 15/2067
USPC ..... 399/329
See application file for complete search history.

(56) References Cited

U.S. PATENT DOCUMENTS 5,300,996 A 4/1994 Yokoyama et al.
5,832,354 A 11/1998 Kouno et al.

(Continued)

FOREIGN PATENT DOCUMENTS

JP 2007-233011 9/2007
JP 2007-334205 12/2007

OTHER PUBLICATIONS

U.S. Appl. No. 13/557,841, filed Jul. 25, 2012, Toshihiko Shimokawa, et al.

(Continued)

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device includes an endless belt rotatable in a predetermined direction of rotation and a nip formation assembly disposed opposite an inner circumferential surface of the endless belt. An opposed rotary body is pressed against the nip formation assembly via the endless belt to form a fixing nip between the endless belt and the opposed rotary body through which a recording medium bearing a toner image is conveyed. A belt holder contacts and supports each lateral end of the endless belt in an axial direction thereof. The belt holder is isolated from the opposed rotary body with a first interval interposed therebetween in the axial direction of the endless belt.

17 Claims, 7 Drawing Sheets

(56) References Cited

U.S. PATENT DOCUMENTS

| | | | | |
|---|---|---|---|---|
| RE36,124 | E | 3/1999 | Yokoyama et al. | |
| 5,915,147 | A | 6/1999 | Kouno et al. | |
| 6,636,709 | B2 | 10/2003 | Furukawa et al. | |
| 2002/0067936 | A1 | 6/2002 | Yasui et al. | |
| 2003/0000933 | A1 | 1/2003 | Yoshinaga et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0247334 | A1 | 12/2004 | Kishi et al. | |
| 2004/0258426 | A1 | 12/2004 | Kishi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0129432 | A1 | 6/2005 | Sato et al. | |
| 2005/0163543 | A1 | 7/2005 | Satoh et al. | |
| 2006/0051120 | A1 | 3/2006 | Kishi et al. | |
| 2006/0116230 | A1 | 6/2006 | Satoh et al. | |
| 2006/0165429 | A1 | 7/2006 | Satoh et al. | |
| 2006/0165448 | A1 | 7/2006 | Yoshinaga | |
| 2006/0177232 | A1 | 8/2006 | Ehara et al. | |
| 2006/0182460 | A1 | 8/2006 | Kishi et al. | |
| 2006/0245797 | A1* | 11/2006 | Suzuki | 399/328 |
| 2006/0285893 | A1 | 12/2006 | Ishii | |
| 2007/0014600 | A1 | 1/2007 | Ishii et al. | |
| 2007/0014603 | A1 | 1/2007 | Satoh et al. | |
| 2007/0059011 | A1 | 3/2007 | Seo et al. | |
| 2007/0059071 | A1 | 3/2007 | Shinshi et al. | |
| 2007/0110464 | A1 | 5/2007 | Nakayama et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0044196 | A1 | 2/2008 | Seo et al. | |
| 2008/0063443 | A1 | 3/2008 | Yoshinaga et al. | |
| 2008/0253789 | A1 | 10/2008 | Yoshinaga et al. | |
| 2008/0317532 | A1 | 12/2008 | Ehara et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0263168 | A1* | 10/2009 | Baba | 399/329 |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0076071 | A1 | 3/2011 | Yamaguchi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0170917 | A1 | 7/2011 | Yoshikawa et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229180 | A1 | 9/2011 | Saito | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |

OTHER PUBLICATIONS

U.S. Appl. No. 13/608,128, filed Sep. 10, 2012, Shuutaroh Yuasa, et al.

* cited by examiner

FIXING DEVICE CAPABLE OF ENHANCING DURABILITY OF ENDLESS BELT AND IMAGE FORMING APPARATUS INCORPORATING THE SAME

CROSS-REFERENCE TO RELATED APPLICATION

This patent application is based on and claims priority pursuant to 35 U.S.C. §119 to Japanese Patent Application No. 2012-003264, filed on Jan. 11, 2012, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time required to output the recording medium bearing the toner image onto the outside of the image forming apparatus after the image forming apparatus receives a print job. Additionally, the fixing device is requested to generate an increased amount of heat before a plurality of recording media is conveyed through the fixing device continuously at an increased speed.

To address these requests, the fixing device may employ a thin endless belt having a decreased thermal capacity and therefore heated quickly by a heater. FIG. 1 illustrates a fixing device 20R1 incorporating an endless belt 100 heated by a heater 300. As shown in FIG. 1, a pressing roller 400 is pressed against a tubular metal thermal conductor 200 disposed inside a loop formed by the endless belt 100 to form a fixing nip N between the pressing roller 400 and the endless belt 100. The heater 300 disposed inside the metal thermal conductor 200 heats the entire endless belt 100 via the metal thermal conductor 200. As the pressing roller 400 rotating clockwise and the endless belt 100 rotating counterclockwise in FIG. 1 convey a recording medium P bearing a toner image T through the fixing nip N in a recording medium conveyance direction A1, the endless belt 100 and the pressing roller 400 apply heat and pressure to the recording medium P, thus fixing the toner image T on the recording medium P.

Since the metal thermal conductor 200 heats the endless belt 100 entirely, the endless belt 100 is heated to a predetermined fixing temperature quickly, thus meeting the above-described requests of shortening the first print time and generating the increased amount of heat for high speed printing. However, in order to shorten the first print time further and save more energy, the fixing device is requested to heat the endless belt more efficiently. To address this request, a configuration to heat the endless belt directly, not via the metal thermal conductor, is proposed as shown in FIG. 2.

FIG. 2 illustrates a fixing device 20R2 in which the heater 300 heats the endless belt 100 directly. Instead of the metal thermal conductor 200 depicted in FIG. 1, a nip formation plate 500, disposed inside the loop formed by the endless belt 100, presses against the pressing roller 400 via the endless belt 100 to form the fixing nip N between the endless belt 100 and the pressing roller 400. Since the nip formation plate 500 does not encircle the heater 300 unlike the metal thermal conductor 200 depicted in FIG. 1, the heater 300 heats the endless belt 100 directly, thus improving heating efficiency for heating the endless belt 100 and thereby shortening the first print time further and saving more energy.

However, the endless belt 100 shown in FIG. 2, as it is not supported by the metal thermal conductor 200 unlike the endless belt 100 shown in FIG. 1, is exerted with various stresses. For example, as shown in FIG. 3A, as the pressing roller 400 rotating in a rotation direction Q1 frictionally slides over the endless belt 100 pressed against the pressing roller 400 by the nip formation plate 500, friction between the pressing roller 400 and the endless belt 100 exerts shear forces indicated by arrows S1 and S2 to the endless belt 100. As shown in FIG. 3B, if the endless belt 100 is skewed in a direction K1 as it rotates, a lateral edge of the endless belt 100 in the axial direction thereof comes into contact with a belt holder 600 that regulates movement of the endless belt 100. Accordingly, as the lateral edge of the endless belt 100 frictionally slides over the belt holder 600, shear forces indicated by arrows S3 and S4 are exerted to the lateral edge of the endless belt 100. As shown in FIG. 3C, if the endless belt 100 is formed into an ellipse in cross-section to facilitate separation of a recording medium from the endless belt 100, the endless belt 100 has different curvatures at positions X and Y and therefore is exerted with a bending force repeatedly.

Those forces generate various stresses that may be concentrated on both lateral ends of the endless belt 100 in the axial direction thereof. As a result, both lateral ends of the endless belt 100 are susceptible to damage or breakage, degrading durability of the endless belt 100.

SUMMARY OF THE INVENTION

This specification describes below an improved fixing device. In one exemplary embodiment of the present invention, the fixing device includes an endless belt rotatable in a predetermined direction of rotation and a nip formation assembly disposed opposite an inner circumferential surface of the endless belt. An opposed rotary body is pressed against the nip formation assembly via the endless belt to form a fixing nip between the endless belt and the opposed rotary body through which a recording medium bearing a toner image is conveyed. A belt holder contacts and supports each lateral end of the endless belt in an axial direction thereof. The belt holder is isolated from the opposed rotary body with a first interval interposed therebetween in the axial direction of the endless belt.

This specification further describes an improved image forming apparatus. In one exemplary embodiment of the present invention, the image forming apparatus includes the fixing device described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
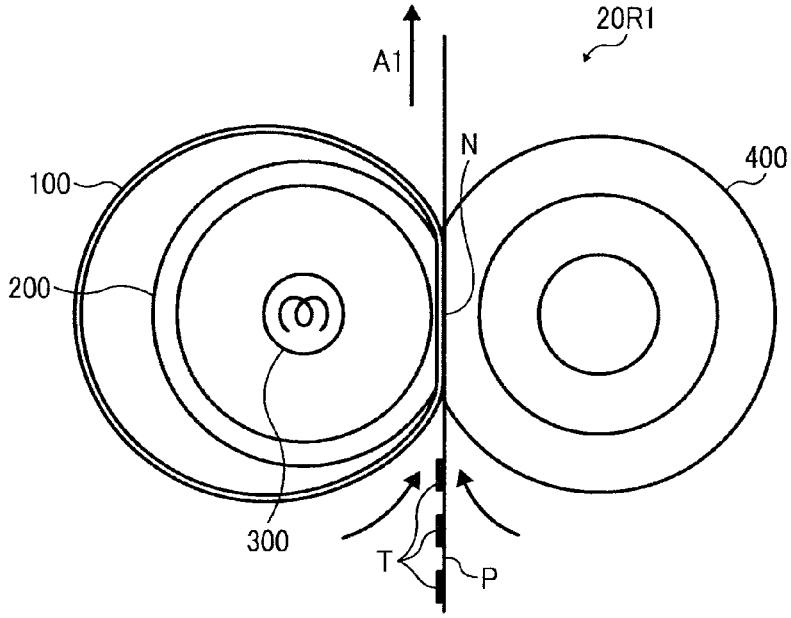
FIG. 1 RELATED ART
FIG. 1 is a vertical sectional view of a first related-art fixing device.
Figure 2:
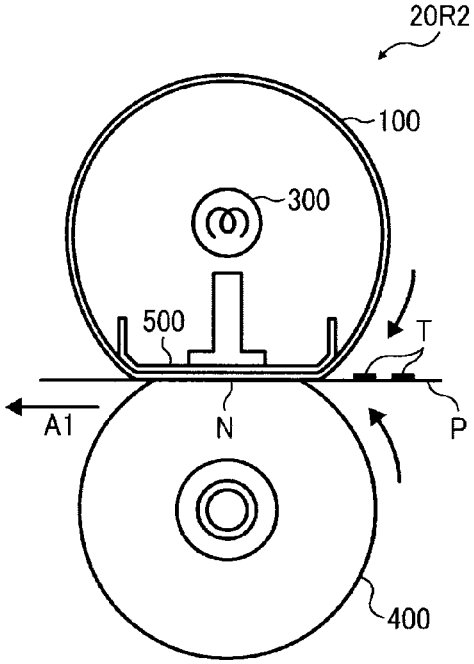
FIG. 2 RELATED ART
FIG. 2 is a vertical sectional view of a second related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 4:
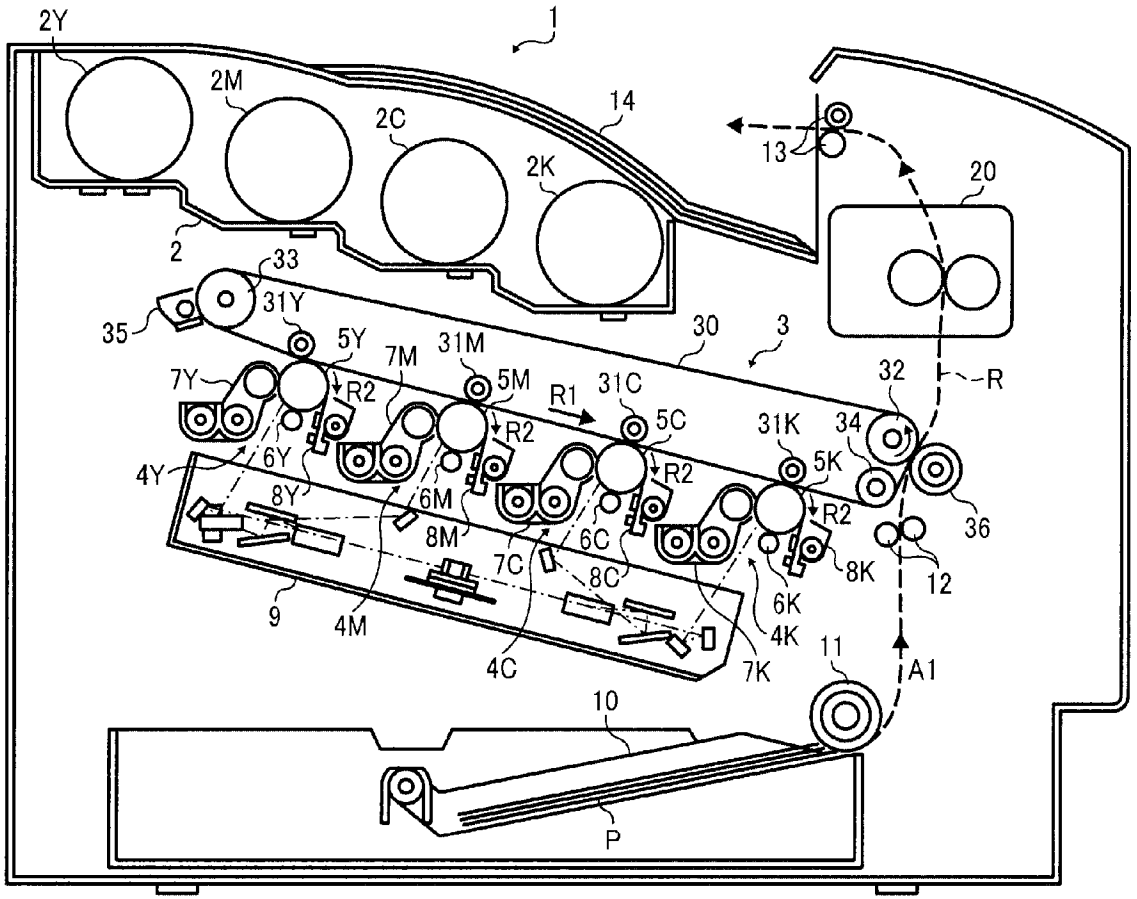
FIG. 4 is a schematic vertical sectional view of an image forming apparatus according to an exemplary embodiment of the present invention.

Referring now to the drawings, wherein like reference numerals designate identical or corresponding parts throughout the several views, in particular to FIG. 4, an image forming apparatus 1 according to an exemplary embodiment of the present invention is explained.

FIG. 4 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this exemplary embodiment, the image forming apparatus 1 is a color laser printer that forms a toner image on a recording medium P by electrophotography.

As shown in FIG. 4, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, the image forming devices 4Y, 4M, 4C, and 4K include drum-shaped photoconductors 5Y, 5M, 5C, and 5K serving as an image carrier that carries an electrostatic latent image and a resultant toner image; chargers 6Y, 6M, 6C, and 6K that charge an outer circumferential surface of the respective photoconductors 5Y, 5M, 5C, and 5K; development devices 7Y, 7M, 7C, and 7K that supply yellow, magenta, cyan, and black toners to the electrostatic latent images formed on the outer circumferential surface of the respective photoconductors 5Y, 5M, 5C, and 5K, thus visualizing the electrostatic latent images into yellow, magenta, cyan, and black toner images with the yellow, magenta, cyan, and black toners, respectively; and cleaners 8Y, 8M, 8C, and 8K that clean the outer circumferential surface of the respective photoconductors 5Y, 5M, 5C, and 5K.

Below the image forming devices 4Y, 4M, 4C, and 4K is an exposure device 9 that exposes the outer circumferential surface of the respective photoconductors 5Y, 5M, 5C, and 5K with laser beams. For example, the exposure device 9, constructed of a light source, a polygon mirror, an f-θ lens, reflection mirrors, and the like, emits a laser beam onto the outer circumferential surface of the respective photoconductors 5Y, 5M, 5C, and 5K according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31Y, 31M, 31C, and 31K serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched over the secondary transfer backup roller 32, the cleaning backup roller 33, and the tension roller 34. As a driver drives and rotates the secondary transfer backup roller 32 counterclockwise in FIG. 4, the secondary transfer backup roller 32 rotates the intermediate transfer belt 30 in a rotation direction R1 by friction therebetween.

The four primary transfer rollers 31Y, 31M, 31C, and 31K sandwich the intermediate transfer belt 30 together with the four photoconductors 5Y, 5M, 5C, and 5K, respectively, forming four primary transfer nips between the intermediate transfer belt 30 and the photoconductors 5Y, 5M, 5C, and 5K. The primary transfer rollers 31Y, 31M, 31C, and 31K are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31Y, 31M, 31C, and 31K, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the development devices 7Y, 7M, 7C, and 7K through toner supply tubes interposed between the toner bottles 2Y, 2M, 2C, and 2K and the development devices 7Y, 7M, 7C, and 7K, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, tracing paper, OHP (overhead projector) transparencies, OHP film sheets, and the like. Additionally, a bypass tray may be attached to the image forming apparatus 1 that loads postcards, envelopes, OHP transparencies, OHP film sheets, and the like.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 4, a description is provided of an image forming operation of the image forming apparatus 1 having the structure described above to form a color toner image on a recording medium P.

As a print job starts, a driver drives and rotates the photoconductors 5Y, 5M, 5C, and 5K of the image forming devices 4Y, 4M, 4C, and 4K, respectively, clockwise in FIG. 4 in a rotation direction R2. The chargers 6Y, 6M, 6C, and 6K uniformly charge the outer circumferential surface of the respective photoconductors 5Y, 5M, 5C, and 5K at a predetermined polarity. The exposure device 9 emits laser beams onto the charged outer circumferential surface of the respective photoconductors 5Y, 5M, 5C, and 5K according to yellow, magenta, cyan, and black image data contained in image data sent from the external device, respectively, thus forming electrostatic latent images thereon. The development devices 7Y, 7M, 7C, and 7K supply yellow, magenta, cyan, and black toners to the electrostatic latent images formed on the photoconductors 5Y, 5M, 5C, and 5K, visualizing the electrostatic latent images into yellow, magenta, cyan, and black toner images, respectively.

Simultaneously, as the print job starts, the secondary transfer backup roller 32 is driven and rotated counterclockwise in FIG. 4, rotating the intermediate transfer belt 30 in the rotation direction R1 by friction therebetween. A power supply applies a constant voltage or a constant current control voltage having a polarity opposite a polarity of the toner to the primary transfer rollers 31Y, 31M, 31C, and 31K. Thus, a transfer electric field is created at the primary transfer nips formed between the primary transfer rollers 31Y, 31M, 31C, and 31K and the photoconductors 5Y, 5M, 5C, and 5K, respectively.

When the yellow, magenta, cyan, and black toner images formed on the photoconductors 5Y, 5M, 5C, and 5K reach the primary transfer nips, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 30 by the transfer electric field created at the primary transfer nips in such a manner that the yellow, magenta, cyan, and black toner images are superimposed successively on a same position on the intermediate transfer belt 30. Thus, a color toner image is formed on the intermediate transfer belt 30. After the primary transfer of the yellow, magenta, cyan, and black toner images from the photoconductors 5Y, 5M, 5C, and 5K onto the intermediate transfer belt 30, the cleaners 8Y, 8M, 8C, and 8K remove residual toner not transferred onto the intermediate transfer belt 30 and therefore remaining on the photoconductors 5Y, 5M, 5C, and 5K therefrom. Thereafter, dischargers discharge the outer circumferential surface of the respective photoconductors 5Y, 5M, 5C, and 5K, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner not transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 5:
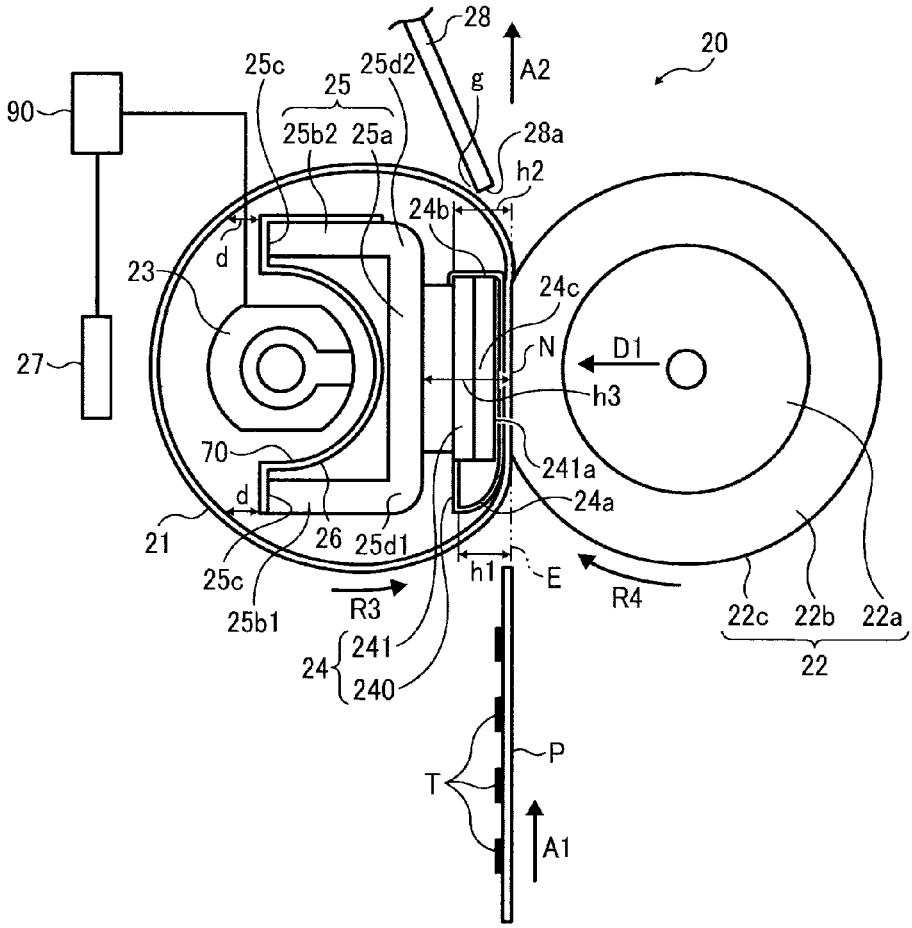
FIG. 5 is a vertical sectional view of a fixing device according to a first exemplary embodiment of the present invention that is installed in the image forming apparatus shown in FIG. 4.

With reference to FIG. 5, a description is provided of a construction of the fixing device 20 according to a first exemplary embodiment that is incorporated in the image forming apparatus 1 described above.

FIG. 5 is a vertical sectional view of the fixing device 20. As shown in FIG. 5, the fixing device 20 (e.g., a fuser) includes a fixing belt 21 serving as a fixing rotary body or an endless belt formed into a loop and rotatable in a rotation direction R3; a pressing roller 22 serving as an opposed rotary body disposed opposite an outer circumferential surface of the fixing belt 21 and rotatable in a rotation direction R4 counter to the rotation direction R3 of the fixing belt 21; a halogen heater 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater 23 toward the fixing belt 21; a temperature sensor 27 serving as a temperature detector disposed opposite the outer circumferential surface of the fixing belt 21 and detecting the temperature of the fixing belt 21; and a separator 28 disposed opposite the outer circumferential surface of the fixing belt 21 and separating the recording medium P from the fixing belt 21. The fixing device 20 further includes a pressurization assembly that presses the pressing roller 22 against the nip formation assembly 24 via the fixing belt 21.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer, made of rubber such as silicone rubber, silicone rubber foam, and fluoro rubber, may be interposed between the base layer and the release layer.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. A driver (e.g., a motor) disposed inside the image forming apparatus 1 depicted in FIG. 4 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. If the pressing roller 22 does not incorporate the elastic layer 22*b*, the pressing roller 22 has a decreased thermal capacity that improves fixing performance of being heated to the predetermined fixing temperature quickly. However, as the pressing roller 22 and the fixing belt 21 sandwich and press a toner image T on the recording medium P passing through the fixing nip N, slight surface asperities of the fixing belt 21 may be transferred onto the toner image T on the recording medium P, resulting in variation in gloss of the solid toner image T. To address this problem, it is preferable that the pressing roller 22 incorporates the elastic layer 22*b* having a thickness not smaller than about 100 micrometers.

The elastic layer 22*b* having the thickness not smaller than about 100 micrometers elastically deforms to absorb slight surface asperities of the fixing belt 21, preventing variation in gloss of the toner image T on the recording medium P. The elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21. According to this exemplary embodiment, the pressing roller 22 is pressed against the fixing belt 21. Alternatively, the pressing roller 22 may merely contact the fixing belt 21 with no pressure therebetween.

A detailed description is now given of a configuration of the halogen heater 23.

Both lateral ends of the halogen heater 23 in a longitudinal direction thereof parallel to an axial direction of the fixing belt 21 are mounted on side plates of the fixing device 20, respectively. A power supply situated inside the image forming apparatus 1 supplies power to the halogen heater 23 so that the halogen heater 23 heats the fixing belt 21. A controller 90, that is, a central processing unit (CPU), provided with a random-access memory (RAM) and a read-only memory (ROM), for example, operatively connected to the halogen heater 23 and the temperature sensor 27 controls the halogen heater 23 based on the temperature of the fixing belt 21 detected by the temperature sensor 27 so as to adjust the temperature of the fixing belt 21 to a desired fixing temperature. Alternatively, an induction heater, a resistance heat generator, a carbon heater, or the like may be employed as a heater to heat the fixing belt 21 instead of the halogen heater 23.

A detailed description is now given of a construction of the nip formation assembly 24.

The nip formation assembly 24 includes a base pad 241 and a slide sheet 240 (e.g., a low-friction sheet) covering an outer surface of the base pad 241. A longitudinal direction of the base pad 241 is parallel to an axial direction of the fixing belt 21 or the pressing roller 22. The base pad 241 receives pressure from the pressing roller 22 to define the shape of the fixing nip N. The base pad 241 is mounted on and supported by the stay 25. Accordingly, even if the base pad 241 receives pressure from the pressing roller 22, the base pad 241 is not bent by the pressure and therefore produces a uniform nip width throughout the axial direction of the pressing roller 22. The stay 25 is made of metal having an increased mechanical strength, such as stainless steel and iron, to prevent bending of the nip formation assembly 24. According to this exemplary embodiment, an opposed face 241*a* of the base pad 241 disposed opposite the pressing roller 22 via the fixing belt 21 is planar to produce the straight fixing nip N that reduces pressure exerted to the base pad 241 by the pressing roller 22.

The base pad 241 is made of a rigid, heat-resistant material having an increased mechanical strength and a heat resistance against temperatures not lower than about 200 degrees centigrade. Accordingly, even if the base pad 241 is heated to a predetermined fixing temperature range, the base pad 241 is not thermally deformed, thus retaining the desired shape of the fixing nip N stably and thereby maintaining the quality of the fixed toner image T on the recording medium P. For example, the base pad 241 is made of general heat-resistant resin such as polyether sulfone (PES), polyphenylene sulfide (PPS), liquid crystal polymer (LCP), polyether nitrile (PEN), polyamide imide (PAI), and polyether ether ketone (PEEK), metal, ceramic, or the like.

The slide sheet 240 is interposed at least between the base pad 241 and the fixing belt 21. For example, the slide sheet 240 covers at least the opposed face 241*a* of the base pad 241 disposed opposite the fixing belt 21 at the fixing nip N. That is, the base pad 241 contacts the fixing belt 21 indirectly via the slide sheet 240. As the fixing belt 21 rotates in the rotation direction R3, it slides over the slide sheet 240 with decreased friction therebetween, decreasing a driving torque exerted on the fixing belt 21. Alternatively, the nip formation assembly 24 may not incorporate the slide sheet 240.

A detailed description is now given of a construction of the reflector 26.

The reflector 26 is interposed between the stay 25 and the halogen heater 23. According to this exemplary embodiment, the reflector 26 is mounted on the stay 25. For example, the reflector 26 is made of aluminum, stainless steel, or the like. The reflector 26 has a reflection face 70 that reflects light radiated from the halogen heater 23 thereto toward the fixing belt 21. Accordingly, the fixing belt 21 receives an increased amount of light from the halogen heater 23 and thereby is heated efficiently. Additionally, the reflector 26 minimizes transmission of radiation heat from the halogen heater 23 to the stay 25, thus saving energy.

A shield is interposed between the halogen heater 23 and the fixing belt 21 at both lateral ends of the fixing belt 21 in the axial direction thereof. The shield shields the fixing belt 21 against heat from the halogen heater 23. For example, even if a plurality of small recording media P is conveyed through the fixing nip N continuously, the shield prevents heat from the halogen heater 23 from being conducted to both lateral ends of the fixing belt 21 in the axial direction thereof where the small recording media P are not conveyed. Accordingly, both lateral ends of the fixing belt 21 do not overheat even in the absence of large recording media P that draw heat therefrom. Consequently, the shield minimizes thermal wear and damage of the fixing belt 21.

The fixing device 20 according to this exemplary embodiment attains various improvements to save more energy and shorten a first print time required to output a recording medium P bearing a fixed toner image T onto the outside of the image forming apparatus 1 depicted in FIG. 4 after the image forming apparatus 1 receives a print job.

As a first improvement, the fixing device 20 employs a direct heating method in which the halogen heater 23 directly heats the fixing belt 21 at a portion thereof other than a nip portion thereof facing the fixing nip N. For example, as shown in FIG. 5, no component is interposed between the halogen heater 23 and the fixing belt 21 at an outward portion of the fixing belt 21 disposed opposite the temperature sensor 27. Accordingly, radiation heat from the halogen heater 23 is directly transmitted to the fixing belt 21 at the outward portion thereof.

As a second improvement, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. The loop diameter of the fixing belt 21 is in a range of from about 20 mm to about 40 mm. In order to decrease the thermal capacity of the fixing belt 21 further, the fixing belt 21 may have a total thickness not greater than about 0.20 mm, preferably not greater than about 0.16 mm. Additionally, the loop diameter of the fixing belt 21 may be not greater than about 30 mm.

According to this exemplary embodiment, the pressing roller 22 has a diameter in a range of from about 20 mm to about 40 mm so that the loop diameter of the fixing belt 21 is equivalent to the diameter of the pressing roller 22. However, the loop diameter of the fixing belt 21 and the diameter of the pressing roller 22 are not limited to the above. For example, the loop diameter of the fixing belt 21 may be smaller than the diameter of the pressing roller 22. In this case, the curvature of the fixing belt 21 at the fixing nip N is greater than that of the pressing roller 22, facilitating separation of the recording medium P discharged from the fixing nip N from the fixing belt 21.

Since the fixing belt 21 has a decreased loop diameter, space inside the loop formed by the fixing belt 21 is small. To address this circumstance, both ends of the stay 25 in the recording medium conveyance direction A1 are folded into a bracket that accommodates the halogen heater 23. Thus, the stay 25 and the halogen heater 23 are placed in the small space inside the loop formed by the fixing belt 21.

In contrast to the stay 25, the nip formation assembly 24 is compact, thus allowing the stay 25 to extend as long as possible in the small space inside the loop formed by the fixing belt 21. For example, the length of the base pad 241 of the nip formation assembly 24 is smaller than that of the stay 25 in the recording medium conveyance direction A1.

As shown in FIG. 5, the base pad 241 includes an upstream portion 24*a* disposed upstream from the fixing nip N in the recording medium conveyance direction A1; a downstream portion 24*b* disposed downstream from the fixing nip N in the recording medium conveyance direction A1; and a center portion 24*c* interposed between the upstream portion 24*a* and the downstream portion 24*b* in the recording medium conveyance direction A1. A height h1 defines a height of the upstream portion 24*a* from the fixing nip N or its hypothetical extension E in a pressurization direction D1 of the pressing roller 22 in which the pressing roller 22 is pressed against the nip formation assembly 24. A height h2 defines a height of the downstream portion 24*b* from the fixing nip N or its hypothetical extension E in the pressurization direction D1 of the pressing roller 22. A height h3, that is, a maximum height of the base pad 241, defines a height of the center portion 24*c* from the fixing nip N or its hypothetical extension E in the pressurization direction D1 of the pressing roller 22. The height h3 is not smaller than the height h1 and the height h2. Hence, the upstream portion 24*a* of the base pad 241 of the nip formation assembly 24 is not interposed between the inner circumferential surface of the fixing belt 21 and an upstream curve 25*d*1 of the stay 25 in a diametrical direction of the fixing belt 21. Similarly, the downstream portion 24*b* of the base pad 241 of the nip formation assembly 24 is not interposed between the inner circumferential surface of the fixing belt 21 and a downstream curve 25*d*2 of the stay 25 in the diametrical direction of the fixing belt 21 and the pressurization direction D1 of the pressing roller 22. Accordingly, the upstream curve 25*d*1 and the downstream curve 25*d*2 of the stay 25 are situated in proximity to the inner circumferential surface of the fixing belt 21. Consequently, the stay 25 having an increased size that enhances the mechanical strength thereof is accommodated in the limited space inside the loop formed by the fixing belt 21. As a result, the stay 25, with its enhanced mechanical strength, supports the nip formation assembly 24 properly, preventing bending of the nip formation assembly 24 caused by pressure from the pressing roller 22 and thereby improving fixing performance.

As shown in FIG. 5, the stay 25 includes a base 25*a* contacting the nip formation assembly 24 and an upstream projection 25*b*1 and a downstream projection 25*b*2, constituting a pair of projections, projecting from the base 25*a*. The base 25*a* extends in the recording medium conveyance direction A1, that is, a vertical direction in FIG. 5. The upstream projection 25*b*1 and the downstream projection 25*b*2 project from an upstream end and a downstream end of the base 25*a*, respectively, in the recording medium conveyance direction A1 and extend in the pressurization direction D1 of the pressing roller 22 orthogonal to the recording medium conveyance direction A1. The upstream projection 25*b*1 and the downstream projection 25*b*2 projecting from the base 25*a* in the pressurization direction D1 of the pressing roller 22 elongate a cross-sectional area of the stay 25 in the pressurization direction D1 of the pressing roller 22, increasing the section modulus and the mechanical strength of the stay 25.

Additionally, as the upstream projection 25*b*1 and the downstream projection 25*b*2 elongate further in the pressurization direction D1 of the pressing roller 22, the mechanical strength of the stay 25 becomes greater. Accordingly, it is preferable that a front edge 25*c* of each of the upstream projection 25*b*1 and the downstream projection 25*b*2 is situated as close as possible to the inner circumferential surface of the fixing belt 21 to allow the upstream projection 25*b*1 and the downstream projection 25*b*2 to project longer from the base 25*a* in the pressurization direction D1 of the pressing roller 22. However, since the fixing belt 21 swings or vibrates as it rotates, if the front edge 25*c* of each of the upstream projection 25*b*1 and the downstream projection 25*b*2 is excessively close to the inner circumferential surface of the fixing belt 21, the swinging or vibrating fixing belt 21 may come into contact with the upstream projection 25*b*1 or the downstream projection 25*b*2. For example, if the thin fixing belt 21 is used as in this exemplary embodiment, the thin fixing belt 21 swings or vibrates substantially. Accordingly, it is necessary to position the front edge 25*c* of each of the upstream projection 25*b*1 and the downstream projection 25*b*2 with respect to the fixing belt 21 carefully.

Specifically, as shown in FIG. 5, a distance d between the front edge 25*c* of each of the upstream projection 25*b*1 and the downstream projection 25*b*2 and the inner circumferential surface of the fixing belt 21 in the pressurization direction D1 of the pressing roller 22 is at least about 2.0 mm, preferably not smaller than about 3.0 mm. Conversely, if the fixing belt 21 is thick and therefore barely swings or vibrates, the distance d is about 0.02 mm. It is to be noted that if the reflector 26 is attached to the front edge 25*c* of each of the upstream projection 25*b*1 and the downstream projection 25*b*2 as in this exemplary embodiment, the distance d is determined by considering the thickness of the reflector 26 so that the reflector 26 does not contact the fixing belt 21.

The front edge 25*c* of each of the upstream projection 25*b*1 and the downstream projection 25*b*2 situated as close as possible to the inner circumferential surface of the fixing belt 21 allows the upstream projection 25*b*1 and the downstream projection 25*b*2 to project longer from the base 25*a* in the pressurization direction D1 of the pressing roller 22. Accordingly, even if the fixing belt 21 has a decreased loop diameter, the stay 25 having the longer upstream projection 25*b*1 and the longer downstream projection 25*b*2 attains an enhanced mechanical strength.

With reference to FIG. 5, a description is provided of a fixing operation of the fixing device 20 described above.

As the image forming apparatus 1 depicted in FIG. 4 is powered on, the power supply supplies power to the halogen heater 23 and at the same time the driver drives and rotates the pressing roller 22 clockwise in FIG. 5 in the rotation direction R4. Accordingly, the fixing belt 21 rotates counterclockwise in FIG. 5 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the pressing roller 22 and the fixing belt 21 pressed by the pressing roller 22. The fixing belt 21 heated by the halogen heater 23 heats the recording medium P and at the same time the pressing roller 22 pressed against the fixing belt 21 and the fixing belt 21 together exert pressure to the recording medium P, thus fixing the toner image T on the recording medium P.

The recording medium P bearing the fixed toner image T is discharged from the fixing nip N in a recording medium conveyance direction A2. A front edge 28*a* of the separator 28 situated in proximity to an exit of the fixing nip N is isolated from the outer circumferential surface of the fixing belt 21 with a separation gap g therebetween. As a leading edge of the recording medium P discharged from the fixing nip N comes into contact with the front edge 28*a* of the separator 28, the separator 28 separates the recording medium P from the fixing belt 21. Thereafter, the separated recording medium P is discharged by the output roller pair 13 depicted in FIG. 4 onto the outside of the image forming apparatus 1, that is, the output tray 14 where the recording media P are stocked.

Figure 6A:
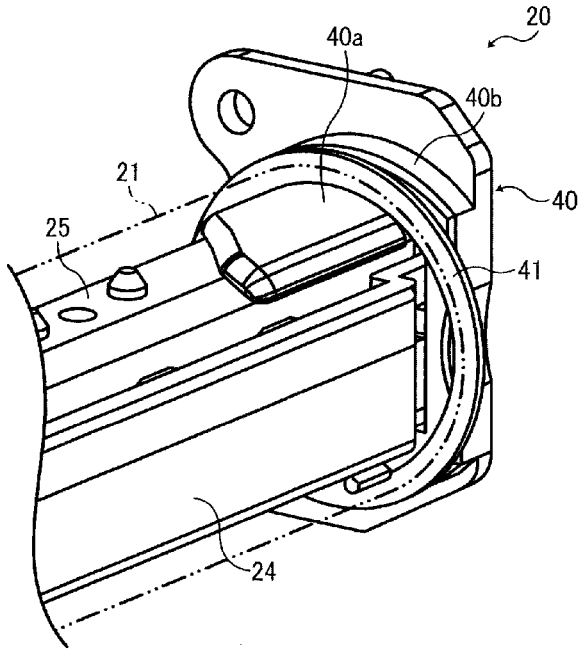
FIG. 6A is a partial perspective view of the fixing device shown in FIG. 5 illustrating one lateral end of a fixing belt incorporated therein in an axial direction thereof.
Figure 6B:
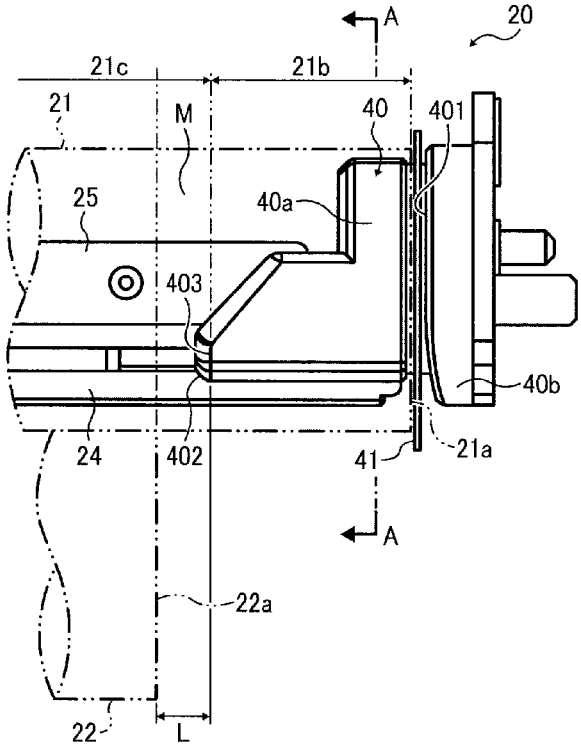
FIG. 6B is a partial plan view of the fixing device shown in FIG. 6A.
Figure 6C:
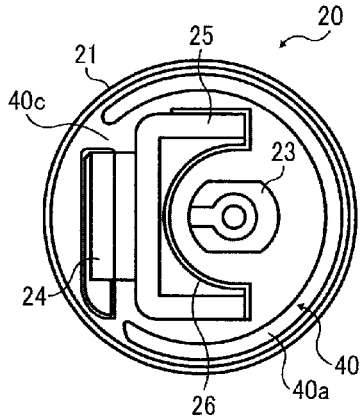
FIG. 6C is a vertical sectional view of the fixing belt shown in FIG. 6A taken on the line A-A of FIG. 6B.

With reference to FIGS. 6A to 6C, a description is provided of a support mechanism that supports both lateral ends of the fixing belt 21 in the axial direction thereof.

FIG. 6A is a partial perspective view of the fixing device 20 illustrating one lateral end of the fixing belt 21 in the axial direction thereof. FIG. 6B is a partial plan view of the fixing device 20 illustrating one lateral end of the fixing belt 21 in the axial direction thereof. FIG. 6C is a vertical sectional view of the fixing belt 21 taken on the line A-A of FIG. 6B illustrating one lateral end in the axial direction thereof.

As shown in FIGS. 6A and 6B, the fixing device 20 further includes a belt holder 40 inserted inside the loop formed by the fixing belt 21 in such a manner that the belt holder 40 is disposed opposite the inner circumferential surface of the fixing belt 21. The belt holder 40 rotatably supports each lateral end 21*b* of the fixing belt 21 in the axial direction thereof. Each belt holder 40 is mounted on a side plate of the fixing device 20, that is mounted on a frame of the image forming apparatus 1 depicted in FIG. 4. Thus, the fixing device 20 is installed in the image forming apparatus 1. Although not shown, another lateral end 21*b* of the fixing belt 21 in the axial direction thereof has the identical configuration shown in FIGS. 6A to 6C. Hence, the following describes the configuration of one lateral end 21*b* of the fixing belt 21 in the axial direction thereof attached with the belt holder 40 with reference to FIGS. 6A to 6C.

As shown in FIGS. 6A and 6B, the belt holder 40 is constructed of a tube 40*a* having a tubular outer circumferential surface and a flange 40*b* disposed outboard from the tube 40*a* in the axial direction of the fixing belt 21 and projecting beyond the tube 40*a* in a diametrical direction thereof. The flange 40*b* regulates movement of the fixing belt 21 in the axial direction thereof if the fixing belt 21 is skewed. For example, the belt holder 40 is made of injection molded resin constituting the tube 40*a* and the flange 40*b*. As shown in FIG. 6C, the tube 40*a* has an inverted C-shape in cross-section to create a slit 40*c* at the fixing nip N where the nip formation assembly 24 is situated. The slit 40*c* extends throughout the axial direction of the fixing belt 21 and accommodates the nip formation assembly 24. The tube 40*a* is loosely fitted into the loop formed by the fixing belt 21 to rotatably support each lateral end 21*b* of the fixing belt 21 in the axial direction thereof. As shown in FIG. 6B, each lateral end of the stay 25 in a longitudinal direction thereof parallel to the axial direction of the fixing belt 21 is mounted on and positioned by the belt holder 40.

As shown in FIG. 6B, a slip ring 41 is interposed between a lateral edge 21*a* of the fixing belt 21 and an inward face 401 of the flange 40*b* of the belt holder 40 disposed opposite the lateral edge 21*a* of the fixing belt 21 in the axial direction thereof. The slip ring 41 serves as a protector that protects the lateral end 21*b* of the fixing belt 21 in the axial direction thereof. For example, even if the fixing belt 21 is skewed in the axial direction thereof, the slip ring 41 prevents the lateral edge 21*a* of the fixing belt 21 from coming into contact with the inward face 401 of the flange 40*b* of the belt holder 40 directly, thus minimizing wear and breakage of the lateral edge 21*a* of the fixing belt 21 in the axial direction thereof. Since an inner diameter of the slip ring 41 is sufficiently greater than an outer diameter of the tube 40*a* of the belt holder 40, the slip ring 41 loosely slips on the tube 40*a*. Hence, if the lateral edge 21*a* of the fixing belt 21 contacts the slip ring 41, the slip ring 41 is rotatable in accordance with rotation of the fixing belt 21. Alternatively, the slip ring 41 may be stationary instead of rotating in accordance with rotation of the fixing belt 21. The slip ring 41 is made of heat-resistant, super engineering plastics such as PEEK, PPS, PAI, and PTFE.

Since the belt holders 40 support both lateral ends 21*b* of the fixing belt 21 in the axial direction thereof, respectively, a center 21*c* of the fixing belt 21 in the axial direction thereof interposed between both lateral ends 21*b* is flexibly deformable at a position other than the fixing nip N where the nip formation assembly 24 supports the fixing belt 21. Additionally, since the fixing belt 21 is shaped straight by the nip formation assembly 24 at the fixing nip N as shown in FIG. 5, the fixing belt 21 is constantly exerted with a force that deforms the fixing belt 21 into an ellipse. Accordingly, as the fixing belt 21 rotates, both lateral ends 21*b* of the fixing belt 21 in the axial direction thereof are retained in substantially a perfect circle in cross-section along the diametrical direction of the fixing belt 21. Conversely, the center 21*c* of the fixing belt 21 in the axial direction thereof is deformed into an ellipse in cross-section along the diametrical direction of the fixing belt 21 in a direction of the normal to the fixing nip N as a short direction.

Figure 3A:
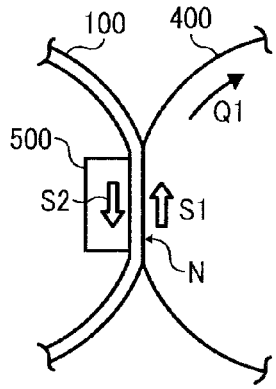
FIG. 3A RELATED ART
FIG. 3A is a partial vertical sectional view of an endless belt and a pressing roller incorporated in the second related-art fixing device shown in FIG. 2.
Figure 3B:
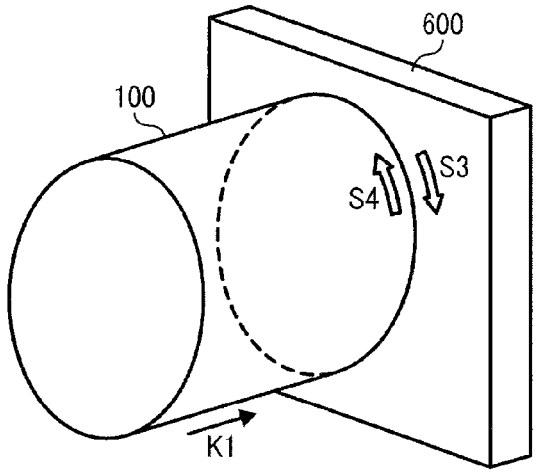
FIG. 3B RELATED ART
FIG. 3B is a partial perspective view of the endless belt and a belt holder incorporated in the second related-art fixing device shown in FIG. 2.
Figure 3C:
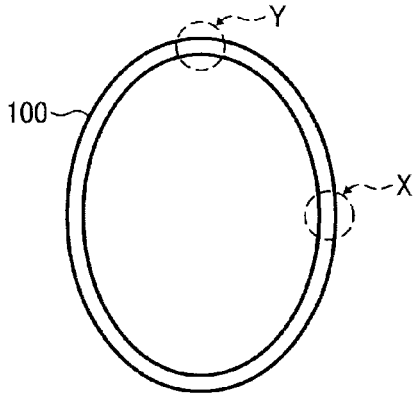
FIG. 3C RELATED ART
FIG. 3C is a vertical sectional view of the endless belt shown in FIG. 3A.

With a configuration in which a length of the pressing roller 22 in the axial direction thereof is equivalent to a length of the fixing belt 21 in the axial direction thereof and the pressing roller 22 overlaps the belt holder 40 in the axial direction of the pressing roller 22, one of both lateral ends 21*b* and their vicinity of the fixing belt 21 in the axial direction thereof may be damaged when the fixing belt 21 is used indefinitely. For example, a border between the center 21*c* and each lateral end 21*b* of the fixing belt 21 in the axial direction thereof may be cracked or streaked in a circumferential direction of the fixing belt 21. Specifically, cracks or streaks may appear along an inward edge 403 of the tube 40*a* other than an outer circumferential chamfer 402 of the tube 40*a*. Damage to the fixing belt 21 may arise as the fixing belt 21 receives three forces, that is, a first shear force at the fixing nip N, a second shear force at each lateral edge 21*a* of the fixing belt 21, and various bending forces at two or more positions on the fixing belt 21. For example, the first shear force may be exerted to the fixing belt 21 by the pressing roller 22 frictionally sliding over the nip formation pad 24 via the fixing belt 21 at the fixing nip N as shown by the arrows S1 and S2 in FIG. 3A. The second shear force may be exerted to the lateral edge 21*a* of the fixing belt 21 as the fixing belt 21 frictionally slides over the belt holder 40 as shown by the arrows S3 and S4 in FIG. 3B. Various bending forces may be exerted to the fixing belt 21 as the fixing belt 21 is deformed into an ellipse as shown in FIG. 3C. As those forces generate stresses that are concentrated on a region of the fixing belt 21 along the inward edge 403 of the tube 40*a*, the fixing belt 21 may be damaged or broken.

To address this problem, as shown in FIG. 6B, the pressing roller 22 does not overlap the belt holder 40 in the axial direction of the fixing belt 21. That is, the pressing roller 22 is isolated from the belt holder 40 in the axial direction of the fixing belt 21. For example, the length of the pressing roller 22 in the axial direction thereof is smaller than that of the fixing belt 21. The inward edge 403 of the tube 40*a* of the belt holder 40 is isolated from a lateral edge 22*a* of the pressing roller 22 in the axial direction of the fixing belt 21 with an interval L therebetween. Hence, a non-overlap band M corresponding to the interval L is created on the outer circumferential surface of the fixing belt 21 along the circumferential direction thereof, which contacts neither the pressing roller 22 nor the belt holder 40. That is, the tube 40*a* is situated outboard from the inward edge 403 in the axial direction of the fixing belt 21. The non-overlap band M produced on the fixing belt 21 prevents cracks and streaks on both lateral ends 21*b* and their vicinity of the fixing belt 21 in the axial direction thereof by minimizing concentration of the above-described stresses on a region on the fixing belt 21 in proximity to the inward edge 403 of the tube 40*a* of the belt holder 40. Accordingly, both lateral ends 21*b* and their vicinity of the fixing belt 21 in the axial direction thereof are neither damaged nor broken, resulting in extension of the life of the fixing device 20 and the image forming apparatus 1 incorporating the fixing device 20.

For example, the interval L corresponding to the non-overlap band M has a length of about 3 mm or more, preferably about 5 mm or more, in the axial direction of the fixing belt 21.

Figure 7:
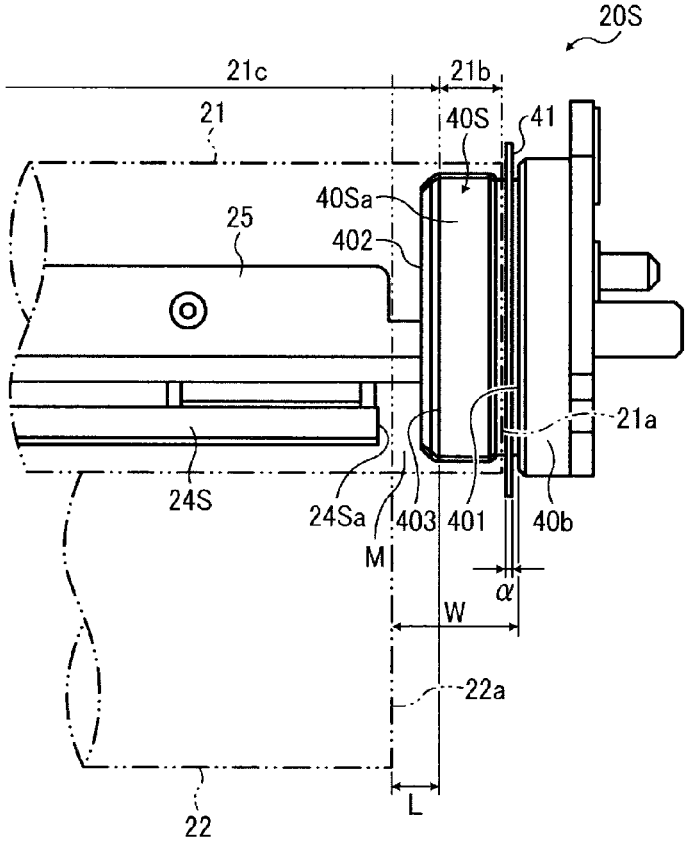
FIG. 7 is a partial horizontal sectional view of a fixing device according to a second exemplary embodiment of the present invention.

With reference to FIG. 7, a description is provided of a configuration of a fixing device 20S according to a second exemplary embodiment.

FIG. 7 is a partial horizontal sectional view of the fixing device 20S illustrating one lateral end 21*b* of the fixing belt 21 in the axial direction thereof. The fixing device 20 shown in FIGS. 6A to 6C includes the tube 40*a* having the inverted C-shape in cross-section and produced with the slit 40*c* accommodating the nip formation assembly 24 extending throughout the axial direction of the fixing belt 21. Conversely, the fixing device 20S shown in FIG. 7 includes a belt holder 40S having a tube 40Sa without the slit 40*c*. Hence, the fixing device 20S includes a nip formation assembly 24S shortened in the axial direction of the fixing belt 21 and thereby interposed between the two tubes 40Sa situated at both lateral ends 21*b* of the fixing belt 21 in the axial direction thereof. Thus, each lateral edge 24Sa of the nip formation assembly 24S is situated inboard from each lateral edge 22*a* of the pressing roller 22 in the axial direction of the fixing belt 21.

Like in the fixing device 20 depicted in FIGS. 6A to 6C, the pressing roller 22 of the fixing device 20S does not overlap the belt holder 40S in the axial direction of the fixing belt 21. That is, the pressing roller 22 is isolated from the belt holder 40S with the interval L therebetween in the axial direction of the fixing belt 21, preventing cracks and streaks on both lateral ends 21*b* and their vicinity of the fixing belt 21 in the axial direction thereof. The interval L between the lateral edge 22*a* of the pressing roller 22 and the inward edge 403 of the tube 40Sa of the belt holder 40S in the axial direction of the fixing belt 21 is about 3 mm or more, preferably about 5 mm or more. An interval W defines a distance between the inward face 401 of the flange 40*b* of the belt holder 40S and the lateral edge 22*a* of the pressing roller 22 in the axial direction thereof. A value obtained by subtracting a thickness α of the slip ring 41 from the interval W is about 10 mm or more.

The non-overlap band M corresponding to the interval L is created on the outer circumferential surface of the fixing belt 21 along the circumferential direction thereof, which contacts none of the pressing roller 22, the nip formation assembly 24S, and the belt holder 40S. The non-overlap band M of the fixing belt 21 is isolated from the pressing roller 22, the nip formation assembly 24S, and the belt holder 40S and therefore is flexibly deformable. Accordingly, concentration of the above-described stresses caused by the first shear force, the second shear force, and the bending forces on a region of the fixing belt 21 in proximity to the inward edge 403 of the tube 40Sa is minimized, enhancing durability of the fixing belt 21.

Figure 8:
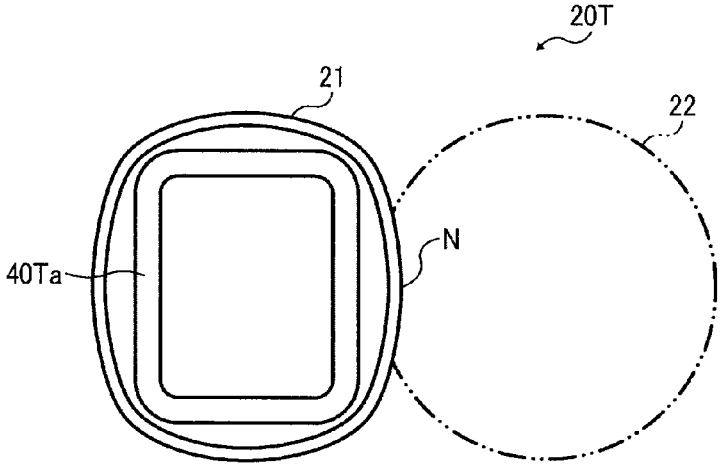
FIG. 8 is a schematic vertical sectional view of a fixing device as a variation of the fixing device shown in FIG. 7.

With reference to FIG. 8, a description is provided of a configuration of a fixing device 20T incorporating a tube 40Ta as a variation of the tubes 40*a* and 40Sa depicted in FIGS. 6B and 7, respectively.

FIG. 8 is a schematic vertical sectional view of the fixing belt 21, the pressing roller 22, and the tube 40Ta of the fixing device 20T. The tube 40*a* shown in FIG. 6C and the tube 40Sa shown in FIG. 7 are substantially circular in cross-section. Conversely, the tube 40Ta is substantially rectangular in cross-section as shown in FIG. 8. The substantially rectangular tube 40Ta supporting the fixing belt 21 increases the curvature of the fixing belt 21 at a position in proximity to the exit of the fixing nip N, that is, decreases the radius of curvature of the fixing belt 21, thus facilitating separation of a recording medium P from the fixing belt 21 as the front edge 28*a* of the separator 28 depicted in FIG. 5 contacts the recording medium P.

Figure 9:
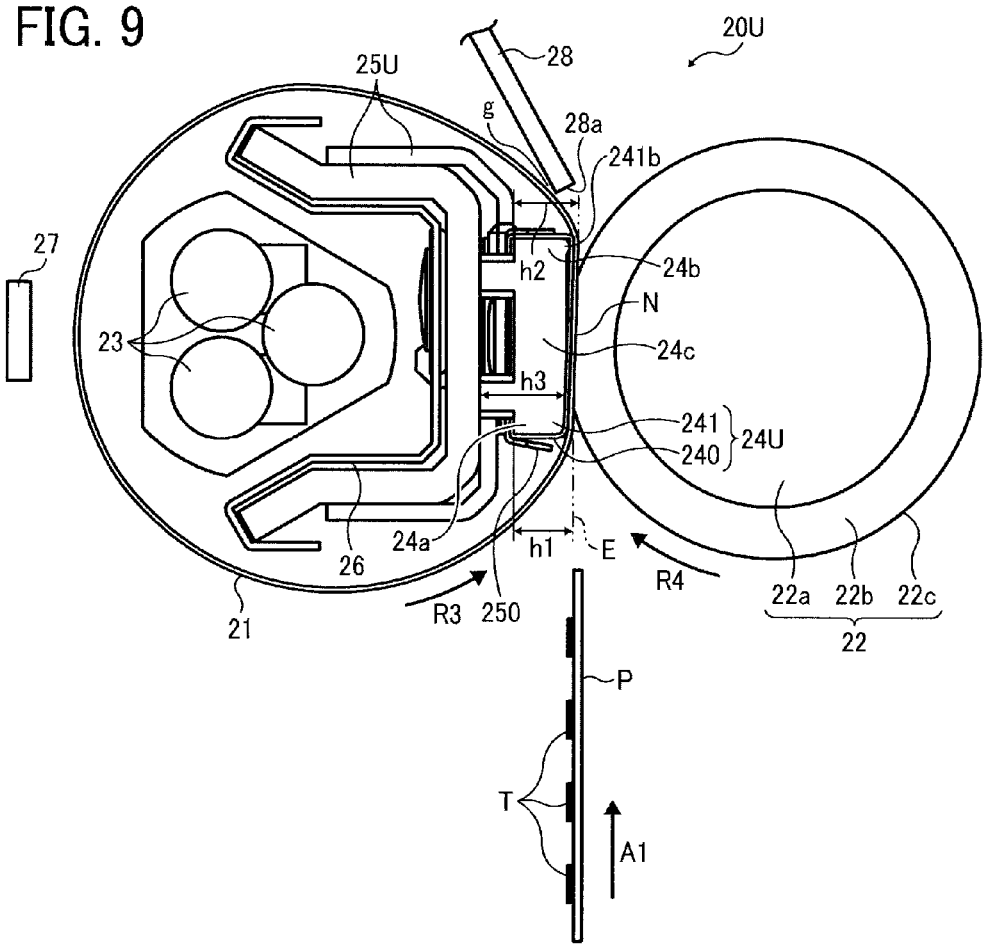
FIG. 9 is a vertical sectional view of a fixing device according to a third exemplary embodiment of the present invention.
Figure 10:
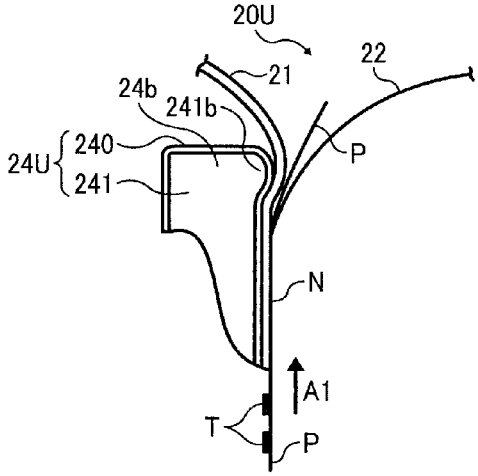
FIG. 10 is a partially enlarged vertical sectional view of the fixing device shown in FIG. 9 illustrating a nip formation assembly incorporated therein.

With reference to FIGS. 9 and 10, a description is provided of a configuration of a fixing device 20U according to a third exemplary embodiment.

FIG. 9 is a vertical sectional view of the fixing device 20U. FIG. 10 is a partially enlarged vertical sectional view of the fixing device 20U illustrating the exit of the fixing nip N. Unlike the fixing device 20 depicted in FIG. 5, the fixing device 20U includes three halogen heaters 23 serving as heaters that heat the fixing belt 21. The three halogen heaters 23 have three different regions thereof in the axial direction of the fixing belt 21 that generate heat. Accordingly, the three halogen heaters 23 heat the fixing belt 21 in three different regions on the fixing belt 21, respectively, in the axial direction thereof so that the fixing belt 21 heats recording media P of various widths in the axial direction of the fixing belt 21. The fixing device 20U further includes a metal plate 250 that partially surrounds a nip formation assembly 24U. Thus, a substantially trapezoidal stay 25U accommodating the three halogen heaters 23 supports the nip formation assembly 24U via the metal plate 250.

The fixing device 20U includes the belt holder 40 shown in FIG. 6B or the belt holder 40S shown in FIG. 7 that is isolated from the pressing roller 22 with the interval L therebetween in the axial direction of the fixing belt 21, thus creating the non-overlap band M on the fixing belt 21 that prevents cracks and streaks on both lateral ends 21*b* and their vicinity of the fixing belt 21 in the axial direction thereof.

As shown in FIG. 9, like the base pad 241 of the nip formation assembly 24 shown in FIG. 5, the base pad 241 of the nip formation assembly 24U includes the upstream portion 24*a* having the height h1; the downstream portion 24*b* having the height h2; and the center portion 24*c* having the height h3 not smaller than the height h1 and the height h2. As shown in FIG. 10, the nip formation assembly 24U includes a projection 241*b* projecting from the downstream portion 24*b* disposed downstream from the fixing nip N in the recording medium conveyance direction A1 toward the pressing roller 22. The projection 241*b* directs a recording medium P sliding over the fixing belt 21 toward the pressing roller 22 as the recording medium P is discharged from the fixing nip N, thus facilitating separation of the recording medium P from the fixing belt 21. The nip formation assembly 24U is also installable in the fixing devices 20, 20S, and 20T shown in FIGS. 5, 7, and respectively.

With reference to FIGS. 5 to 10, a description is provided of advantages of the fixing devices 20, 20S, 20T, and 20U described above.

The fixing devices 20, 20S, 20T, and 20U include the endless fixing belt 21 serving as an endless belt rotatable in the rotation direction R3; the belt holder (e.g., the belt holders 40 and 40S) contacting and supporting each lateral end 21*b* of the fixing belt 21 in the axial direction thereof; the heater (e.g., one or more halogen heaters 23) to heat the fixing belt 21; the nip formation assembly (e.g., the nip formation assemblies 24, 24S, and 24U) disposed inside the loop formed by the fixing belt 21; and the pressing roller 22 serving as an opposed rotary body pressed against the nip formation assembly via the fixing belt 21 to form the fixing nip N between the pressing roller 22 and the fixing belt 21. The pressing roller 22 is isolated from the belt holder with the interval L, that is, a first interval, interposed therebetween in the axial direction of the fixing belt 21, thus creating the non-overlap band M on the outer circumferential surface of the fixing belt 21, which contacts neither the pressing roller 22 nor the belt holder. The non-overlap band M minimizes concentration of various stresses exerted on the fixing belt 21 and thereby prevents damage to each lateral end 21*b* and its vicinity of the fixing belt 21 indefinitely.

For example, the belt holder includes the tube (e.g., the tubes 40*a*, 40Sa, and 40Ta) disposed opposite the inner circumferential surface of the fixing belt 21 and the flange 40*b* projecting beyond the tube in the diametrical direction of the tube. The inward edge 403 of the tube is isolated from the lateral edge 22*a* of the pressing roller 22 in the axial direction of the fixing belt 21 with the interval L therebetween. The interval L is not smaller than about 5 mm in the axial direction of the fixing belt 21.

As shown in FIG. 6B, the fixing belt 21 has the non-overlap band M along the circumferential direction thereof where the fixing belt 21 contacts neither the pressing roller 22 nor the belt holder 40, thus minimizing concentration of various stresses exerted on the fixing belt 21 and thereby preventing damage to the fixing belt 21 indefinitely.

As shown in FIG. 7, the fixing belt 21 has the non-overlap band M along the circumferential direction thereof where the fixing belt 21 contacts none of the pressing roller 22, the belt holder 40S, and the nip formation assembly 24S, minimizing concentration of various stresses exerted on the fixing belt 21 and thereby enhancing durability of the fixing belt 21.

It is preferable that the fixing belt 21 rotates in accordance with rotation of the pressing roller 22.

As shown in FIG. 8, the tube 40Ta has a noncircular outer circumference, for example, a substantially rectangular outer circumference, in cross-section which facilitates separation of the recording medium P from the fixing belt 21 by the separator 28. In order to achieve the similar advantage, the nip formation assembly 24U has the projection 241*b* situated downstream from the fixing nip N in the recording medium conveyance direction A1 and projecting toward the pressing roller 22.

As shown in FIGS. 6B and 7, the pressing roller 22 does not overlap the belt holders 40 and 40S in the axial direction of the fixing belt 21. That is, the pressing roller 22 is isolated from the belt holders 40 and 40S in the axial direction of the fixing belt 21, minimizing concentration of various stresses exerted on each lateral end 21*b* and its vicinity of the fixing belt 21 in the axial direction thereof. Accordingly, damage and breakage of each lateral end 21*b* and its vicinity of the fixing belt 21 are prevented indefinitely, enhancing durability of the fixing belt 21 and extending the life of the fixing devices 20, 20S, 20T, and 20U and the image forming apparatus 1 incorporating the fixing device 20, 20S, 20T, or 20U.

The exemplary embodiments described above are applied to the fixing devices 20, 20S, 20T, and 20U incorporating the thin fixing belt 21 having a reduced loop diameter to save more energy. Alternatively, the exemplary embodiments described above are applicable to other fixing devices. Additionally, as shown in FIG. 4, the image forming apparatus 1 incorporating the fixing device 20, 20S, 20T, or 20U is a color laser printer. Alternatively, the image forming apparatus 1 may be a monochrome printer, a copier, a facsimile machine, a multifunction printer (MFP) having at least one of copying, printing, facsimile, and scanning functions, or the like.

According to the exemplary embodiments described above, the pressing roller 22 serves as an opposed rotary body disposed opposite the fixing belt 21. Alternatively, a pressing belt or the like may serve as an opposed rotary body. Further, the halogen heater 23 disposed inside the fixing belt 21 serves as a heater that heats the fixing belt 21. Alternatively, the halogen heater 23 may be disposed outside the fixing belt 21.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt rotatable in a predetermined direction of rotation;

a nip formation assembly disposed opposite an inner circumferential surface of the endless belt;

an opposed rotary body pressed against the nip formation assembly via the endless belt to form a fixing nip between the endless belt and the opposed rotary body through which a recording medium bearing a toner image is conveyed; and a belt holder contacting and supporting each lateral end of the endless belt in an axial direction thereof, the belt holder isolated from the opposed rotary body with a first interval interposed therebetween in the axial direction of the endless belt, wherein the endless belt includes a non-overlap band corresponding to the first interval, the non-overlap band disposed along a circumferential direction of the endless belt.

2. The fixing device according to claim 1, wherein the first interval is not smaller than about 5 mm in the axial direction of the endless belt.

3. The fixing device according to claim 1, wherein the non-overlap band of the endless belt contacts neither the opposed rotary body nor the belt holder.

4. The fixing device according to claim 1, wherein the belt holder includes:

a tube disposed opposite the inner circumferential surface of the endless belt and including an inward edge isolated from a lateral edge of the opposed rotary body; and a flange projecting beyond the tube in a diametrical direction of the tube, and wherein the lateral edge of the opposed rotary body is disposed inboard from the inward edge of the tube with the first interval interposed therebetween in the axial direction of the endless belt.

5. The fixing device according to claim 4, wherein the tube has a noncircular outer circumference in cross-section.

6. The fixing device according to claim 4, wherein the tube has a substantially rectangular outer circumference in cross-section.

7. The fixing device according to claim 4, wherein the tube of the belt holder includes a slit extending throughout the axial direction of the endless belt and accommodating the nip formation assembly.

8. The fixing device according to claim 4, wherein a lateral edge of the nip formation assembly is disposed inboard from the lateral edge of the opposed rotary body in the axial direction of the endless belt.

9. The fixing device according to claim 8, wherein the non-overlap band of the endless belt contacts none of the opposed rotary body, the belt holder, and the nip formation assembly.

10. The fixing device according to claim 8, further comprising a slip ring interposed between the tube and the flange of the belt holder and separatably contactable to a lateral edge of the endless belt in the axial direction of the endless belt, the slip ring having a thickness in the axial direction of the endless belt, wherein the flange includes an inward face isolated from the lateral edge of the opposed rotary body with a second interval therebetween in the axial direction of the endless belt, and wherein a length obtained by subtracting the thickness of the slip ring from the second interval is not smaller than about 10 mm.

11. The fixing device according to claim 1, wherein the endless belt rotates in accordance with rotation of the opposed rotary body.

12. The fixing device according to claim 1, wherein the nip formation assembly includes a projection disposed downstream from the fixing nip in a recording medium conveyance direction and projecting toward the opposed rotary body.

13. The fixing device according to claim 12, wherein the nip formation assembly further includes:

a base pad pressed by the opposed rotary body and mounting the projection, the base pad including an opposed face disposed opposite the opposed rotary body via the endless belt; and a low-friction sheet covering at least the opposed face of the base pad.

14. The fixing device according to claim 1, further comprising a heater disposed opposite the inner circumferential surface of the endless belt to heat the endless belt.

15. The fixing device according to claim 14, wherein the heater includes a halogen heater.

16. The fixing device according to claim 1, wherein the opposed rotary body includes a pressing roller.

17. An image forming apparatus comprising the fixing device according to claim 1.

* * * * *